US008659615B2

(12) United States Patent
Martyn et al.

(10) Patent No.: US 8,659,615 B2
(45) Date of Patent: Feb. 25, 2014

(54) SYSTEM AND METHOD FOR PROVIDING TRANSPARENT WINDOWS OF A DISPLAY

(75) Inventors: Thomas C. Martyn, Woodinville, WA (US); Richard L. Clark, Kirkland, WA (US)

(73) Assignee: Nvidia Corporation, Santa Clara, CA (US)

( * ) Notice: Subject to any disclaimer, the term of this patent is extended or adjusted under 35 U.S.C. 154(b) by 2833 days.

(21) Appl. No.: 10/388,127

(22) Filed: Mar. 12, 2003

(65) Prior Publication Data

US 2004/0179017 A1 Sep. 16, 2004

Related U.S. Application Data

(63) Continuation-in-part of application No. 10/356,653, filed on Jan. 31, 2003, now abandoned.

(51) Int. Cl.
*G09G 5/02* (2006.01)

(52) U.S. Cl.
USPC ..... 345/592; 345/426; 345/522; 345/581

(58) Field of Classification Search
USPC ..... 345/548, 592
See application file for complete search history.

(56) References Cited

U.S. PATENT DOCUMENTS

| | | | | | |
|---|---|---|---|---|---|
| 5,283,554 | A * | 2/1994 | Edelson et al. | ..... | 345/593 |
| 5,299,309 | A * | 3/1994 | Kuo et al. | ..... | 345/541 |
| 5,381,347 | A * | 1/1995 | Gery | ..... | 345/548 |
| 5,388,207 | A * | 2/1995 | Chia et al. | ..... | 345/548 |
| 5,457,482 | A * | 10/1995 | Rhoden et al. | ..... | 345/548 |
| 5,651,107 | A * | 7/1997 | Frank et al. | ..... | 715/768 |
| 5,831,615 | A * | 11/1998 | Drews et al. | ..... | 715/768 |
| 5,838,336 | A * | 11/1998 | Ross | ..... | 345/536 |
| 5,999,191 | A * | 12/1999 | Frank et al. | ..... | 345/634 |
| 6,151,030 | A * | 11/2000 | DeLeeuw et al. | ..... | 345/592 |
| 6,359,631 | B2 * | 3/2002 | DeLeeuw | ..... | 345/629 |
| 6,429,883 | B1 * | 8/2002 | Plow et al. | ..... | 715/768 |
| 6,683,629 | B1 * | 1/2004 | Friskel et al. | ..... | 715/804 |
| 2003/0107601 | A1 * | 6/2003 | Ryzhov | ..... | 345/769 |
| 2003/0110307 | A1 * | 6/2003 | De Armas et al. | ..... | 709/310 |

OTHER PUBLICATIONS nVIDIA Corporation, "nView Desktop Manager User's Guide," Driver version 31.00, Aug. 2002, 15 pages.
MS Developers Network Library, "Using Windows," www.msdn.microsoft.com/library/default.asp, printed Aug. 1, 2003, 3 pages.
MS Developers Network Library, "SetWindowLong Function," www.msdn.microsoft.com/library/default.asp, printed Aug. 1, 2003, 3 pages.
MS Developers Network Library, "SetLayeredWindowAttributes Function," www.msdn.microsoft.com/library/default.asp, printed Aug. 1, 2003, 2 pages.
MS Developers Network Library, "UpdateLayeredWindow Function," www.msdn.microsoft.com/library/default.asp, printed Aug. 1, 2003, 2 pages.

* cited by examiner

*Primary Examiner* — Phi Hoang
(74) *Attorney, Agent, or Firm* — Kilpatrick Townsend & Stockton LLP

(57) ABSTRACT

Systems and methods for managing window transparency for a computer display, making windows wholly transparent or semi-transparent, on a window-by-window basis. Window transparency is triggered by monitoring messages exchanged between a program and an operating system, or by a user action. Upon detection of a first message indicating that a window of the display should be transparent, a layered display mode for the window is initiated. Upon detection of a second message indicating that the window should no longer be transparent, the layered display mode for the window is terminated. The layered mode can be controlled by the operating system or by a graphics processor.

39 Claims, 4 Drawing Sheets

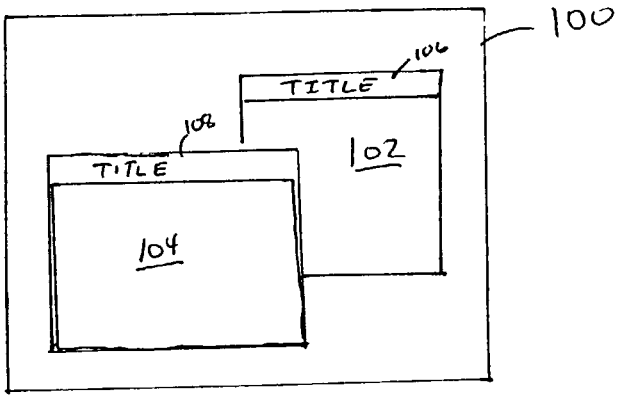
FIG. 1
(PRIOR ART)
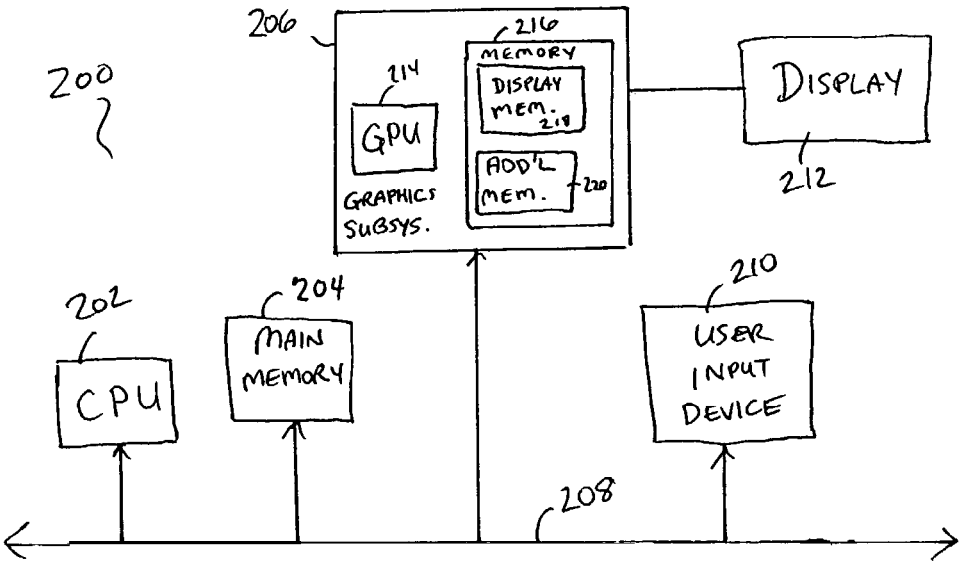

SYSTEM AND METHOD FOR PROVIDING TRANSPARENT WINDOWS OF A DISPLAY

CROSS-REFERENCES TO RELATED APPLICATIONS

This application is a continuation-in-part of U.S. patent application Ser. No. 10/356,653, filed Jan. 31, 2003, which disclosure is incorporated herein by reference for all purposes.

BACKGROUND OF THE INVENTION

The present invention relates in general to computer displays and in particular to a system and method for providing wholly or partially transparent windows in a display for a window-based operating system.

Many operating systems in use today provide a window-based display. A window is generally a rectangular region of the display screen, inside which application data is presented to the user. Typically, each application has one or more associated windows, and multiple windows can be displayed concurrently in a "desktop" image on a display screen. Each application generates the data to be displayed in its window(s). The operating system usually provides various window management functions (e.g., selecting, resizing, hiding, or repositioning windows) so that the user can control the arrangement of windows on the desktop.

An example of a desktop image with two windows is shown in FIG. 1. Desktop image 100 includes windows 102, 104. Each window has a title bar 106, 108 that contains a title for the window. Title bars 106, 108 also provide an interface for window management functions via drop-down menus and/or buttons (not shown).

Some operating systems (e.g., certain versions of Microsoft Windows) provide function calls that an application programmer can invoke to make windows either wholly transparent or semi-transparent (translucent) under certain conditions (e.g., while a user is moving the window). Transparency enables a user to see what is behind a window without removing the front window from the screen. For instance, in FIG. 1, window 104 obscures a portion of window 102; if window 104 is made wholly transparent or translucent, that portion of window 102 becomes wholly or partially visible.

In existing operating systems, window transparency can place a heavy burden on the system memory bandwidth. For instance, in the Microsoft Windows operating system, pixel data for each window on the desktop is normally stored in a display memory (e.g., a frame buffer). Window transparency is enabled by drawing each window that can become transparent in a "layered" mode, in which the pixel data for the window is stored in a main system memory and periodically block transferred to the display memory. The window can then be made semi-transparent by blending the pixel data for the window with the underlying pixel data in the display memory during the block transfer, or wholly transparent by ignoring the pixel data for the window. Because each block transfer consumes bandwidth on the system memory bus, having a large number of layered windows, as is the case in existing systems that support transparency on a global basis, can perceptibly degrade system response.

Improved systems and methods for supporting transparent windows with reduced memory bandwidth requirements would therefore be desirable.

BRIEF SUMMARY OF THE INVENTION

Embodiments of the present invention provide systems and methods for managing window transparency for a computer display. A window may be made wholly transparent or semi-transparent, on a window-by-window (or application-by-application) basis. Windows may automatically be made transparent under particular conditions, e.g., while being moved. In addition, in some embodiments, the user can manually enable and disable transparency for particular windows, e.g., by using a drop-down menu or a "hot key." User-selected transparency settings for an application can be preserved across exiting and restarting the application.

According to one aspect of the invention, a method is provided for displaying transparent windows of a display in a computing system including a central processing unit, a main memory, and a display memory coupled together via a system bus. A program running on the central processing unit provides window data for a window of the display and the window data is stored in the display memory. The program exchanges messages with an operating system running on the central processing unit are monitored. These messages are monitored. In response to a first message indicating that the window should be transparent, the window data for the window is transferred from the display memory to an off screen memory that is local to the display memory, and the window is displayed using a transparent display mode. In response to a second message indicating that the window should no longer be transparent, the window is no longer displayed using the transparent display mode.

According to another aspect of the invention a method is provided for displaying transparent windows of a display in a computing system including a central processing unit, a main memory, and a display memory coupled together via a system bus. A program running on the central processing unit provides window data for a window of the display and the window data is stored in the display memory. The program exchanges messages with an operating system running on the central processing unit are monitored. These messages are monitored. In response to a first message indicating that the window should be transparent, the window data for the window is transferred from the display memory to an off screen memory, and the window is displayed using a transparent display mode. In response to a second message indicating that the window should no longer be transparent, the window is no longer displayed using the transparent display mode. Under a first operating condition, the off screen memory is local to the display memory, and under a second operating condition, the off screen memory is local to the main memory.

According to yet another aspect of the invention, a graphics processing subsystem for generating transparent windows of a display of a computer system having a central processing unit includes a display memory, an off-screen memory, a graphics processor, and a driver module. The display memory is configured to store window data for windows of a display, and the off screen memory is local to the display memory. The graphics processor is coupled to the display memory and the off screen memory and is configured to initiate and terminate a transparent display mode for windows of the display; window data for a window is stored in the off screen memory while the window is in the transparent display mode. The driver module is configured to communicate with the central processing unit and the graphics processor, and is further configured to monitor messages exchanged between a program and an operating system executing on the central processing unit. In response to a first message, the driver module instructs the graphics processor to initiate the transparent display mode for a window, and in response to a second message, the driver module instructs the graphics processor to terminate the transparent display mode for the window.

The following detailed description together with the accompanying drawings will provide a better understanding of the nature and advantages of the present invention.

BRIEF DESCRIPTION OF THE DRAWINGS

FIG. 1 is a drawing of a desktop display for a computing system;

FIG. 2 is a simplified block diagram of a computing system according to an embodiment of the present invention;

DETAILED DESCRIPTION OF THE INVENTION

Figure 3:
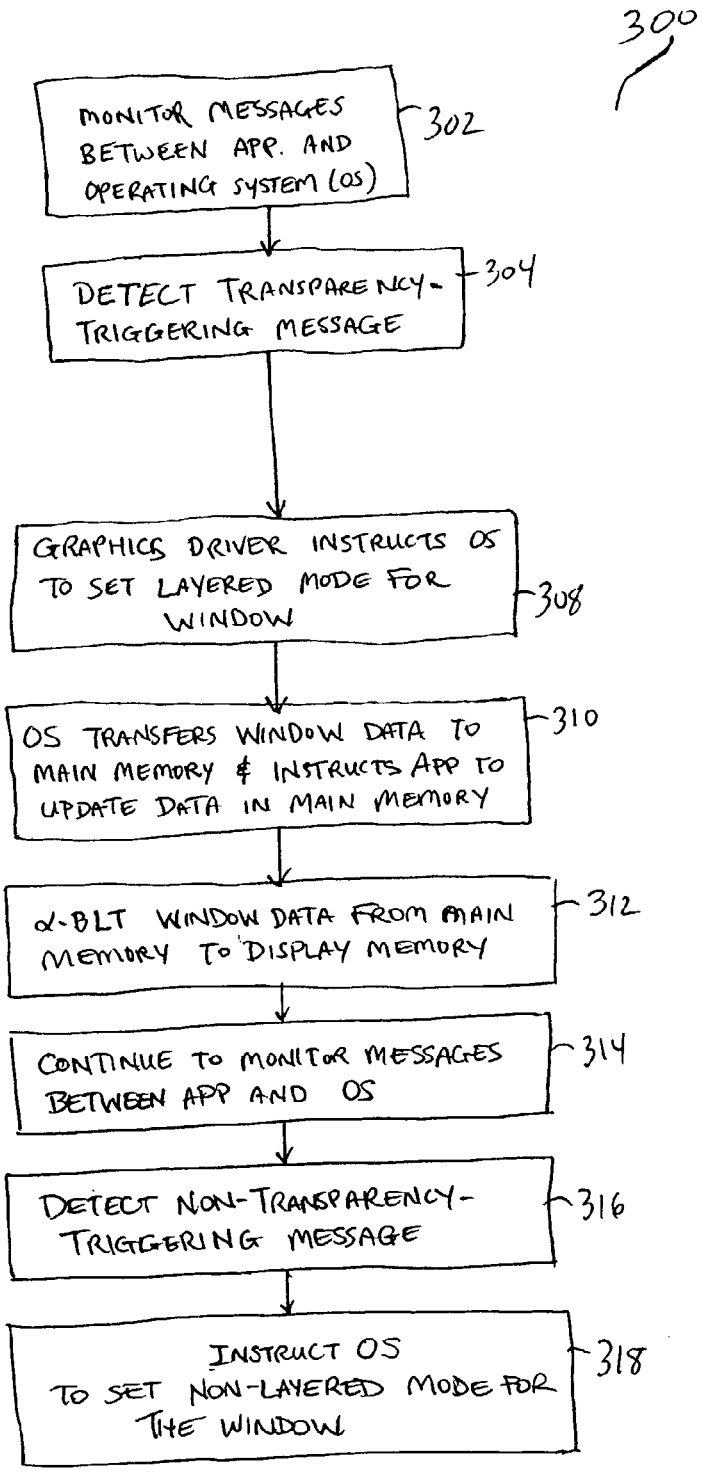
FIG. 3 is a flow diagram of a process for managing window transparency according to a first embodiment of the present invention.

Embodiments of the present invention provide techniques for managing window transparency for a computer display. A window may be made wholly transparent or semi-transparent, on a window-by-window (or application-by-application) basis. As used herein, the term "transparent window" is to be understood as including both wholly transparent and semi-transparent (translucent) windows. Windows may automatically be made transparent under particular conditions, e.g., while being moved. In addition, in some embodiments, the user can manually enable and disable transparency for particular windows, e.g., by using a drop-down menu or a "hot key". User-selected transparency settings for an application can be preserved across exiting and restarting the application.

FIG. 2 is a block diagram of a computer system 200, such as a personal computer, suitable for practicing the present invention. Computer system 200 includes a central processing unit (CPU) 202, a main memory 204, a graphics subsystem 206, and one or more user input devices 210 communicating via a bus 208, as well as a display device 212 controlled by graphics subsystem 206. CPU 202 executes various application programs (e.g., word processing programs, World Wide Web browser programs, etc.), as well as a window-based operating system (e.g., Microsoft Windows) that supports the application programs. The operating system includes an application program interface (API) that the applications use to invoke various operating system services such as opening, closing, and repositioning of the application's windows. The operating system also includes a user interface, or shell, for processing user input. During operation, the application programs and the operating system exchange various messages. For example, user input (e.g., keystrokes or mouse clicks) is normally received first by the operating system shell, which may send the input (or another message related to the input) to one or more of the applications, depending on the input and the current context (e.g., which window is active when the input is received). The application receives the message and, in the course of processing the input, may respond to the operating system with messages of its own.

According to an embodiment of the present invention, CPU 202 also executes a "message hook" program that monitors the messages that are exchanged between the operating system and the application programs in order to detect the occurrence of a message or sequence of messages indicating that a selected one of the windows on the display should be made transparent (i.e., either wholly or semi-transparent). When this condition occurs, the message hook program initiates a transparent display mode for the selected window, as will be described further below. The message hook program may also take other actions, such as blocking or modifying subsequently detected messages, or generating additional messages to the operating system and/or application program. After the transparent display mode is initiated, the message hook program continues to monitor messages exchanged between the operating system and the application; upon detecting a message or sequence of messages indicating that the selected window should no longer be transparent, the message hook program terminates the transparent display mode for that window, causing the window to be displayed as opaque.

Graphics subsystem 206 includes a graphics processor 214 and graphics memory 216. Graphics memory 216 includes a display memory 218 (e.g., a frame buffer) used for storing pixel data for each pixel of display device 212. Pixel data can be provided to display memory 218 directly from CPU 202; alternatively, CPU 202 can provide graphics processor 214 with geometry data from which graphics processor 214 generates pixel data. The pixel data is periodically scanned out from display memory 218 and displayed on display device 212. In some embodiments, graphics memory 216 also includes additional memory areas 220.

In one embodiment, the hardware components of computer system 200 are of generally conventional design. Computer system 200 may also include other components (not shown) such as fixed disk drives, removable disk drives, CD and/or DVD drives, audio components, modems, network interface components, and the like.

It will be appreciated that the system described herein is illustrative and that variations and modifications are possible. The techniques for providing window transparency described herein can be implemented in a variety of computer systems and managed by a graphics processor, within the CPU, or in other components of the computer system.

FIG. 3 is a flow diagram of a process 300 for controlling window transparency in accordance with a first embodiment of the present invention. Process 300 is suitable for use in an operating system that supports a layered mode for windows (e.g., Microsoft Windows 2000 or XP). As used herein, a window is in a layered mode (or layered display mode) when pixel data for the window is directed to an "off-screen" memory location—i.e., an area of memory that is not scanned out—and the window is drawn by transferring the window data to the display memory. The transfer is advantageously implemented as an alpha blending block transfer ($\alpha$-Blt), in which the final pixel value is the sum of the pixel value for the window, weighted by a factor $\alpha(0 \leq \alpha \leq 1)$, and the pixel value stored in the display memory, weighted by a factor $(1-\alpha)$. Thus, $\alpha=1$ corresponds to an opaque window, while $\alpha=0$ corresponds to a completely transparent window; values of $\alpha$ between 0 and 1 correspond to a semi-transparent, or translucent, window. Process 300 enables an operating-system-supported layered mode for a window while it is actually transparent and disables the layered mode for the window at other times, thereby reducing the memory bandwidth required to support window transparency.

At step 302, a global system message hook program executing on CPU 202 monitors messages passed between the operating system and application programs until, at step 304, a triggering message indicating that a window should be made transparent is detected. Various messages can be selected as triggering messages. For instance, in one embodiment, a window is made transparent while a user is repositioning it, and the message hook program detects and recognizes messages or sequences of messages indicating that a window is being moved. In one embodiment, a user moves a window by manipulating a mouse in a conventional "drag and drop" sequence: i.e., the user positions the mouse cursor over the title bar of the window, holds down the left mouse button while moving the mouse to reposition the window, and releases the left mouse button when the window reaches the desired position. This operation can be recognized by detecting a "Left Button Down" message while the mouse cursor is over the title bar and then waiting for a fixed time to determine whether a "Left Button Up" message occurs. If not, then the window is being moved and should be made transparent. In another embodiment, a window may be made transparent in response to some other user action (e.g., pressing a key or a combination or sequence of keys, selecting an item from a drop-down menu, etc.). In each case, the user action causes one or more messages to be passed between the application program and the operating system. It will be appreciated that any message or sequence of messages between the operating system and an application can be used as a triggering message for making a window transparent.

Upon detection of the triggering message, the message hook program invokes an operating system function (e.g., the "SetLayeredWindowAttributes" function in Microsoft Windows) instructing the operating system to enable layered mode for that window (step 308). At step 310, the operating system enables layered mode for the window. In one embodiment, enabling layered mode includes generating a copy of the layered window in an off-screen memory location, removing the pixel data for the window from the display memory, and instructing the application to send subsequent pixel data updates (or drawing commands) to the off-screen memory location rather than to the display memory.

At step 312, a block transfer of the window data for the transparent window to the corresponding portion of the display memory is executed. This block transfer is advantageously executed using alpha blending ($\alpha$-Blt) as described above. Where the operating system supports alpha blending of layered windows, step 312 can be performed under the direction of the operating system as part of its normal processing of a layered window. Step 312 can be executed repeatedly while the window remains transparent.

At step 314, while the window remains transparent, the message hook program continues to monitor messages passed between the applications and the operating system. When a message is detected indicating that a transparent window should become opaque (step 316), the program invokes an appropriate operating system function to disable the layered mode for that window (step 318). Disabling the layered mode causes the window data to be transferred back into the display memory; the operating system then instructs the application program to send subsequent draw commands for the window to the display memory. Thus, at the end of the process, the window is restored to its normal (non-layered, opaque) state.

In process 300, layered mode is enabled for a given window only when it is needed, i.e., when the window is actually being drawn as transparent. Because it is often the case that only a small number of windows are transparent at any given time, the need for transferring window data across the system bus from main memory to the display memory can be reduced, as compared to systems in which all windows are in layered mode.

The demand on the system bus can be further reduced by using an off-screen memory that is local to the display memory, such as additional graphics memory area 220 of FIG. 2. As used herein, "local to" means that data can be passed between the off-screen memory and the display memory without placing the data onto system bus 208. Embodiments that support the use of off-screen memory within the graphics processing subsystem will now be described.

Figure 4:
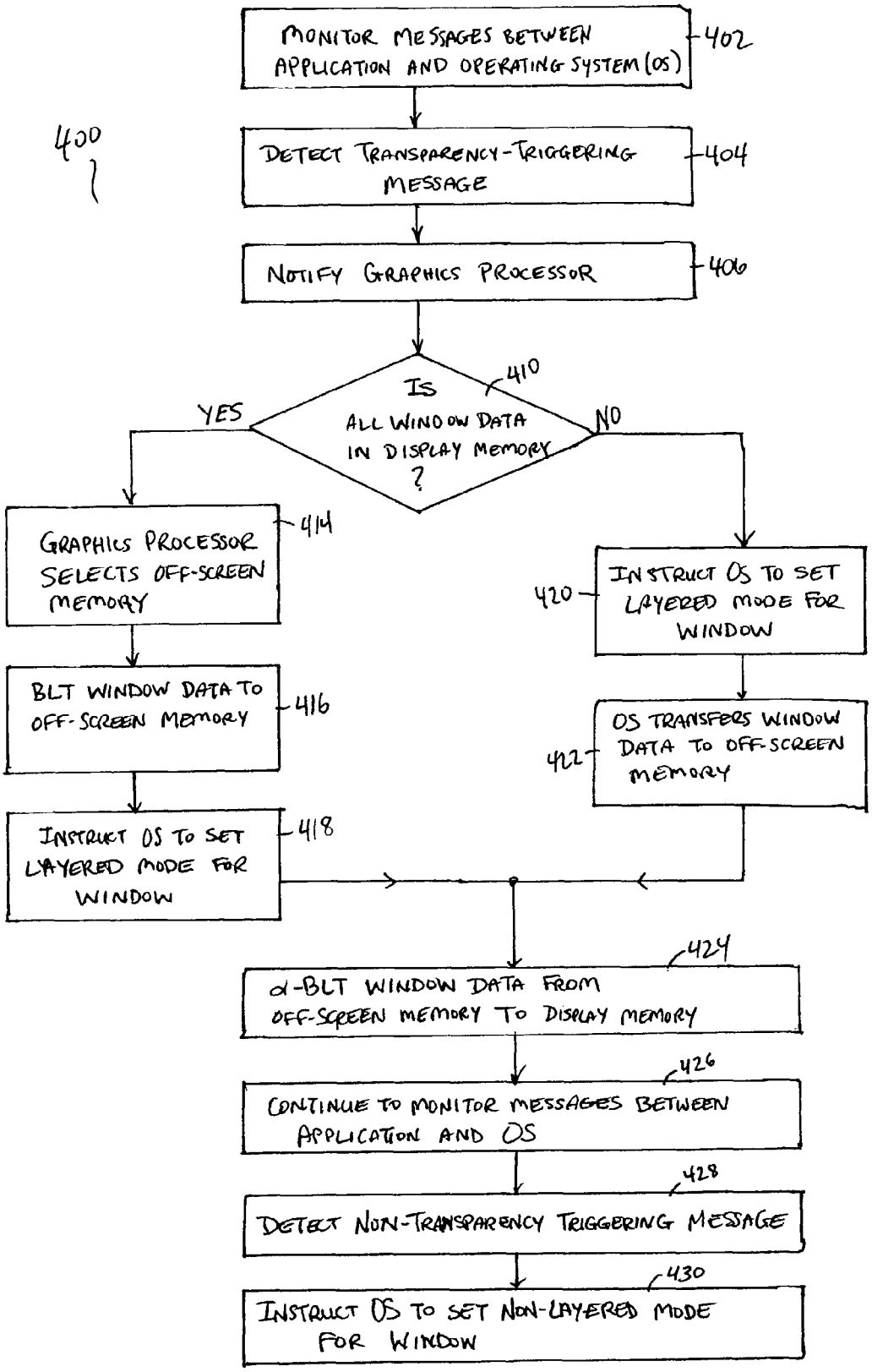
FIG. 4 is a flow diagram of a process for managing window transparency according to a second embodiment of the present invention.

FIG. 4 is a flow diagram illustrating a process 400 for controlling window transparency in accordance with a second embodiment of the present invention. This process includes further control over the initiation of layered mode for a window, e.g., by allowing the graphics processor to select the off-screen memory location for a layered window in at least some instances.

At step 402, a global system message hook program monitors communications between applications and the operating system. At step 404, the message hook program detects a triggering message indicating that a window should be made transparent. Steps 402 and 404 may be implemented similarly to steps 302 and 304 of process 300 described above. At step 406, the message hook program notifies the graphics processor that a window is to be made transparent.

At step 410, the graphics processor (or in an alternative embodiment, the message hook program) determines whether all of the data for the window is present in the display memory. For instance, in one embodiment, data for a window is present in the display memory only to the extent that the window is visible on the display; if part of the window extends past an edge of the display area, data for that part of the window is not stored in the display memory. If all of the data for the window is in the display memory, then at step 414, the graphics processor selects an off-screen memory location to be used to store data for the transparent window. This location may be local to display memory 218 of FIG. 2 (e.g., in memory area 220), so that use of main system bus 208 to perform block transfers of window data is not required. At step 416, data for the window is block transferred from the display memory to the off-screen memory location selected at step 414. This step can be under the control of the graphics processor or the message hook program.

At step 418, the message hook program instructs the operating system to enable layered mode for the window using the selected off-screen memory location. Implementation of step 418 depends on the operating system. For example, the Microsoft Windows operating system provides the "SetLayeredWindowAttributes" function described above, but this function requires the off-screen memory to be located in the main system memory. To support using an off-screen memory located elsewhere (e.g., in the graphics memory area) in Microsoft Windows, selection of the off-screen memory (step 414) and the initial block transfer (step 416) can be performed without using operating system calls. At step 418, the "SetWindowLong" function of the operating system is invoked to enable layered mode.

If, at step 410, at least some of the data for the window is not in the display memory (which may be the case, e.g., if part of the window extends beyond the edge of the display area), then at step 420, the operating system is instructed to enable layered mode for the window using an off-screen memory location selected by the operating system. For instance, in Microsoft Windows, the "SetLayeredWindowAttributes" function can be invoked. At step 422, the operating system transfers the data for the window to the selected off-screen memory location. Since part of the window is not visible on the desktop, this may involve, e.g., instructing the application to draw the window data to the off-screen memory location.

At step 424, the window data is alpha block transferred to the corresponding portion of the display memory in order to display the window as partially transparent. The technique for causing the α-BLT depends on whether the "YES" branch (steps 414, 416, 418) or "NO" branch (steps 420, 422) was taken at step 410. If the "NO" branch was taken, then the operating system can automatically update the layered window as previously described. If, however, the "YES" branch was taken, the layered window is not automatically updated by the operating system. In that case a manual update is performed, e.g., by using the "UpdateLayeredWindow" function of Microsoft Windows or by executing appropriate commands in the graphics processor. Step 424 can be executed repeatedly while the window remains transparent.

At step 426, while the window remains transparent, the process continues to monitor messages passed between the application and the operating system. When a message is detected indicating that the transparent window should be made opaque (step 428), the process instructs the operating system to disable layered mode for the window (step 430), causing the window to be restored to its normal (non-layered, opaque) state. These steps can be implemented similarly to steps 314, 316, and 318 described above.

It will be appreciated that this process is illustrative and that variations and modifications are possible. The sequence of steps can be modified or varied, and steps described sequentially may be performed in parallel in some implementations. The process can also be used to provide multiple transparent windows concurrently.

In addition, in an alternative embodiment, the window data is always stored in off-screen memory that is local to the display memory. In this embodiment, if not all of the window data is in the display memory at step 410, the application can be instructed to redraw its window, with the data directed to the off-screen memory location selected at step 414.

In some instances, the operating system does not support a layered mode for windows, and in other instances, it may not be desirable to use a layered mode supported by the operating system. Transparent windows can still be provided by using the layering techniques described above, as long as updates to the window data are not sent to the display memory while the window is transparent. Some embodiments of the present invention prevent undesired updates to the display memory without relying on an operating system's layered mode.

Figure 5:
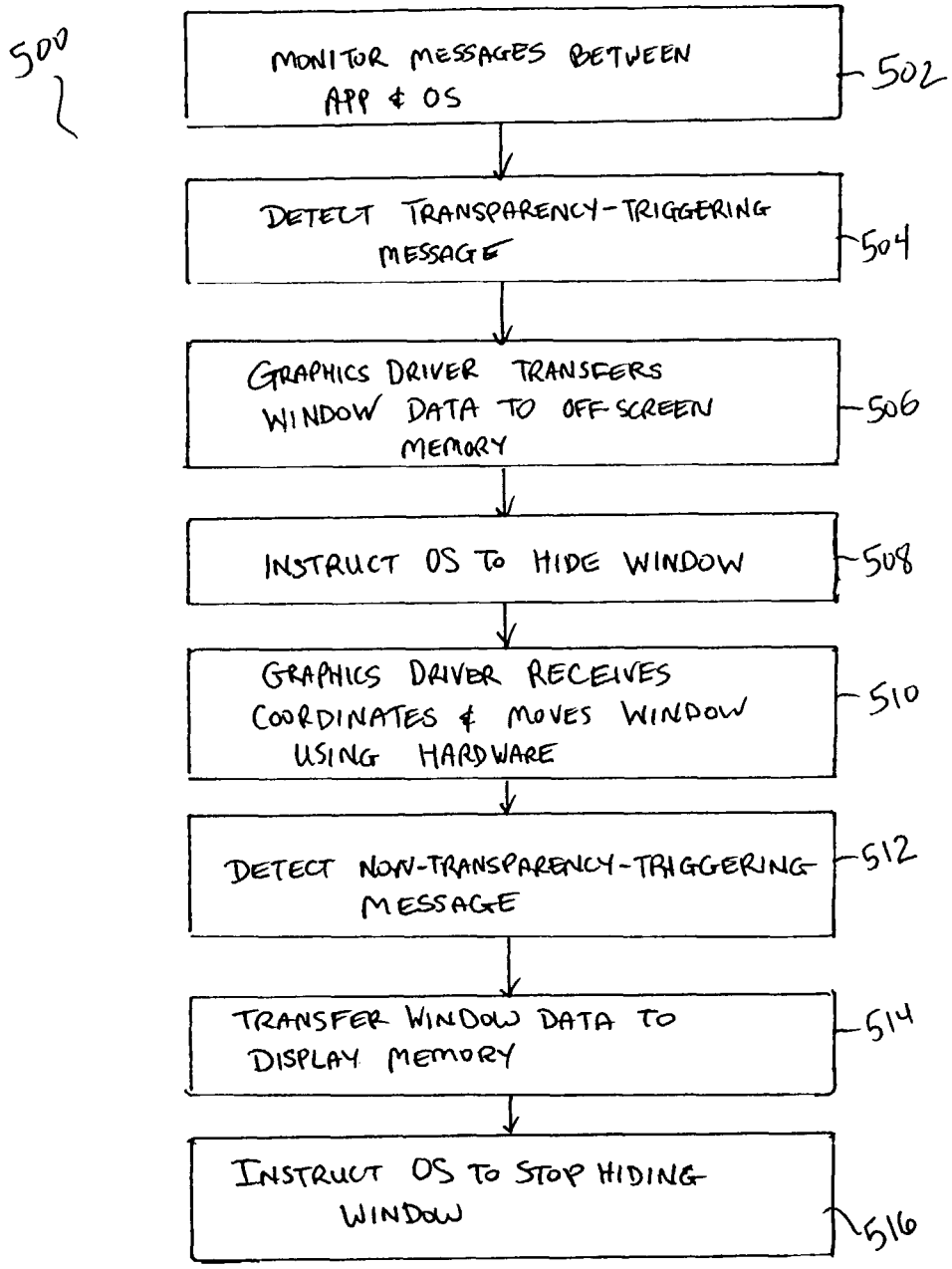
FIG. 5 is a flow diagram of a process for managing window transparency according to a third embodiment of the present invention.

For example, FIG. 5 is a flow diagram illustrating a third embodiment of a process for controlling window transparency in accordance with the present invention. In this embodiment, the operating system is instructed to "hide" the transparent window. As used herein, hiding a window means putting it into a state in which the window data can be updated but the window is not displayed. Various operating systems (e.g., Microsoft Windows) support such a "hidden" state for windows, under various names.

At step 502, the message hook program monitors messages passed between the operating system and applications until, at step 504, a triggering message indicating that a window should be made transparent is detected (e.g., the user starts moving the window). These steps may be implemented similarly to steps 302 and 304 described above.

At step 506, the graphics processor is notified of the transparent window and transfers the window data for that window from the display memory to an off-screen memory location, which may be internal to graphics subsystem 206 of FIG. 2 (e.g., in memory area 220). At step 508, the message hook program instructs the operating system to hide the window. Thus, from the operating system's perspective, the window is hidden, not layered. At step 510, the message hook program intercepts a subsequent user command, such as a coordinate of a mouse cursor for moving the window, and generates a transparent window image by initiating an alpha-blending block transfer of the window data to the display memory. For example, the message hook program may invoke functions of the graphics processor to transfer the data. In this instance, the graphics processor is provided with the window coordinates and size so that the alpha block transfer is directed to the appropriate portion of the display memory. The operating system manages any updates to the window data received from the application in accordance with its procedures for hidden windows. Since hidden windows are not displayed, the updates are not written directly to the display memory.

At step 512, the message hook program detects a message indicating that the window should become opaque (e.g., the user stops moving the window). At step 514, the graphics processor is notified and copies (block transfers) the window data to the appropriate section of the display memory. At step 516, the graphics processor instructs the operating system to show the hidden window, i.e., to restore it to its visible (non-hidden) state.

It will be appreciated that process 500 is illustrative and that alternatives and modifications are possible for providing transparent windows without relying on a layered window mode of an operating system. For example, in one alternative process, the operating system is not instructed to hide or otherwise alter a transparent window. Instead, any updates for the transparent window are intercepted by the message hook program and redirected to the appropriate off-screen memory location, without the operating system being aware that the window is not being displayed in its normal opaque mode. In addition to intercepting messages, the message hook program can also generate messages to either the application or operating system in order to prevent the transparent window from being incorrectly displayed.

In some embodiments of the present invention, window transparency can be managed at an application-specific level. For instance, the message hook program can access or maintain a list of applications for which windows are to be made transparent in response to a particular triggering message and invoke the functionality described above only when the triggering message is generated by an application in the list. For example, some OpenGL-based applications are incompatible with the layered display mode of the Microsoft Windows operating system; in embodiments that use the layered mode, the message hook program can be instructed to ignore messages from OpenGL-based applications.

Other embodiments of the invention allow the user to specify conditions under which an application's windows are to be made transparent. In such embodiments, for each application, the message hook program accesses or maintains a list of messages (or sequences or messages) to be used as transparency triggering messages.

This list of triggering messages can be generated and updated interactively by a user. In one embodiment, a pop-up menu or dialog box for transparency control is available for any application. For each window, a particular user command (e.g., a mouse click, keystroke, or combination or sequence of keystrokes) causes a "transparency" menu to be displayed. The menu options include various conditions under which transparency can be activated for that window. For example, one menu option enables a hot key for toggling the window between transparent and opaque modes. Another menu option is a transparency toggle that causes the window mode to switch between transparent and opaque modes each time it is selected. Yet another menu option is a selection for various conditions under which transparency can be enabled (e.g., transparent on drag). Other menu options and combinations of options can also be implemented.

The menu can also provide an option for controlling the degree of transparency, from nearly opaque to completely transparent. This can be implemented by providing a user-selectable value for the blending parameter $\alpha$ described above. For instance, the user can be prompted to enter a desired value of a or provided with a graphic control that can be adjusted to select the desired degree of transparency. In some embodiments, the value of a is a global parameter. In other embodiments, it can be controlled on an application-by-application basis.

In some embodiments, transparency settings for an application are maintained when the application exits and restarts. For example, the message hook program can detect a message (or sequence of messages) indicating that a window is being closed. Upon detecting such a message, the message hook program causes the current transparency settings for the window to be stored in the system registry. The window can be identified by its module name and window class, or by other appropriate parameters, depending on the operating system. The transparency settings can include, e.g., whether the window is currently transparent, a value of alpha or other parameter indicating the degree of transparency to be used when the window is made transparent, and parameters indicating conditions under which the window is to be made transparent When an application sends a message requesting a new window, the message hook program detects the message and searches the registry using the module name and window class to find the appropriate stored transparency settings. The message hook program then applies these settings to the new window.

It will be appreciated that in embodiments of the present invention, block transferring of window data is required only when windows are transparent. This results in a reduced demand for memory bandwidth and improved system response. Acceptable system response can generally be maintained as long as not too many windows are transparent at a given time. In some embodiments, the availability of transparency is regulated to avoid adversely affecting system response. For instance, the number of windows that are transparent at a given time can be limited to some maximum number, or transparency can be disabled altogether when a shortage of memory bandwidth is detected. A user can be notified (e.g., via a pop-up alert message) when these conditions occur.

While the invention has been described with respect to specific embodiments, one skilled in the art will recognize that numerous modifications are possible. As described above, some embodiments of the invention do not rely on a layered display mode provided by the operating system. Thus, the invention is not limited to operating systems that provide a layered display mode. The off-screen memory for transparent windows can be located in the graphics subsystem, in the main system memory, or in other memory locations; the location can be selected for each window independently. The transparency-control methods described herein can be implemented in one or more programs to be executed by a system CPU, a dedicated graphics processor, or any combination thereof. The methods can also be implemented using special-purpose hardware controlled by a message hook program that executes on the system CPU.

Thus, although the invention has been described with respect to specific embodiments, it will be appreciated that the invention is intended to cover all modifications and equivalents within the scope of the following claims.

What is claimed is:

1. In a computing system including a central processing unit, a main memory, and a display memory coupled together via a system bus, a method for displaying transparent windows of a display, the method comprising:

monitoring messages exchanged between a program and an operating system;

in response to a first message indicating that a window should be transparent:

transferring window data for the window from the display memory to an off screen memory that is local to the display memory, wherein the computing system further comprises a graphics subsystem including a graphics processor and the display memory, the graphics subsystem being configured to select a memory location for storing the window data;

displaying the window using a transparent display mode; and intercepting an update window message from the program instructing the operating system to update the window so that the message from the program is not received by the operating system;

updating the window data in the off screen memory according to the update window message; and displaying the window with the updated window data using the transparent display mode; and in response to a second message indicating that the window should no longer be transparent, no longer displaying the window using the transparent display mode.

2. The method of claim 1, further comprising:

in response to the second message, transferring the window data for the window from the off screen memory to the display memory.

3. The method of claim 1 wherein the act of displaying the window using the transparent display mode includes:

transferring the window data for the window from the off screen memory to the display memory using an alpha blending transfer mode.

4. The method of claim 1 wherein the program and the operating system run on the central processing unit.

5. The method of claim 1 wherein the program provides the window data for the window and the window data is stored in the display memory.

6. The method of claim 1 wherein the window data is passed between the off screen memory and the display memory without placing the window data onto the system bus.

7. The method of claim 1 wherein the off screen memory and the display memory are located within a graphics processing subsystem of the computing system.

8. The method of claim 7 wherein the act of displaying the window using the transparent display mode is performed under control of a graphics processor located within the graphics processing subsystem.

9. The method of claim 7 wherein the act of transferring the window data to the off screen memory is performed under control of a graphics processor located within the graphics processing subsystem.

10. The method of claim 1 wherein the act of displaying the window using the transparent display mode is performed under control of a process executing on the central processing unit.

11. The method of claim 1 wherein the act of transferring the window data to the off screen memory is performed under control of a process executing on the central processing unit.

12. The method of claim 1 wherein the first message is generated in response to a user action.

13. The method of claim 12 wherein the user action includes initiating a window drag of the window.

14. The method of claim 12 wherein the user action includes selecting a transparency setting from a menu associated with the window.

15. The method of claim 12 wherein the user action includes pressing a transparency enabling key associated with the window.

16. The method of claim 1, further comprising:

in response to the first message, instructing the operating system to enable a layered display mode for the window; and in response to the second message, instructing the operating system to disable the layered display mode for the window.

17. The method of claim 1, further comprising:

in response to the first message, instructing the operating system to hide the window; and in response to the second message, instructing the operating system to no longer hide the window.

18. The method of claim 1, further comprising:

in response to the first message, disregarding drawing commands from the operating system regarding the window; and in response to the second message, no longer disregarding drawing commands from the operating system regarding the window.

19. The method of claim 1, further comprising;

in response to the first message, beginning to intercept messages from the program to the operating system; and in response to the second message, discontinuing intercepting of messages from the program to the operating system.

20. The method of claim 1, further comprising:

providing a user interface that enables a user to set a transparency parameter for the window.

21. The method of claim 20, wherein the transparency parameter indicates a condition under which the window should be transparent.

22. The method of claim 20 wherein the transparency parameter indicates a degree of transparency to be applied to the window when the window is transparent.

23. The method of claim 20, further comprising:

in response to a third message indicating that the window is to be closed, storing the transparency parameter in a system registry in association with an identifier of the program.

24. The method of claim 23, further comprising, in response to a fourth message indicating that a new window is to be opened:

accessing an identifier of a program requesting the new window;

retrieving a transparency parameter from the system registry using the identifier; and applying the transparency parameter to the new window.

25. In a computing system including a central processing unit, a main memory, and a display memory coupled together via a system bus, a method for displaying transparent windows of a display, the method comprising:

monitoring messages exchanged between a program and an operating system;

in response to a first message indicating that a window should be transparent:

transferring window data for the window from the display memory to an off screen memory, wherein the computing system further comprises a graphics subsystem including a graphics processor and the display memory, the graphics subsystem being configured to select a memory location for storing the window data; and displaying the window using a transparent display mode;

intercepting an update window message from the program instructing the operating system to update the window so that the message from the program is not received by the operating system;

updating the window data in the off screen memory according to the update window message; and displaying the window with the updated window data using the transparent display mode; and in response to a second message indicating that the window should no longer be transparent, no longer displaying the window using the transparent display mode, wherein under a first operating condition, the off screen memory is local to the display memory, and wherein under a second operating condition, the off screen memory is local to the main memory.

26. The method of claim 25 wherein:

under the first operating condition, the act of displaying the window using the transparent display mode is performed under control of a graphics processing unit local to the display memory; and under the second operating condition, the act of displaying the window using the transparent display mode is performed using an automatic function of the operating system.

27. The method of claim 25, further comprising:

in response to the first message, determining whether complete window data for the window is in the display memory, wherein the first operating condition occurs when complete window data is in the display memory and the second operating condition occurs when complete window data is not in the display memory.

28. A graphics processing subsystem for generating transparent windows of a display of a computer system having a central processing unit, the graphics processing subsystem comprising:

a display memory configured to store window data for windows of a display;

an off screen memory local to the display memory;

a graphics processor coupled to the display memory and the off screen memory and configured to control a transparent display mode for windows of the display, wherein window data for a window is stored in the off screen memory while the window is in the transparent display mode, wherein the graphics processor is configured to selects a memory location for storing the window data; and a driver module configured to communicate with the central processing unit and the graphics processor, the driver module further configured to monitor messages exchanged between a program and an operating system executing on the central processing unit, wherein, in response to a first message, the driver module instructs the graphics processor to initiate the transparent display mode for a window and wherein, in response to a second message, the driver module instructs the graphics processor to terminate the transparent display mode for the window, wherein the driver module is further configured to initiate interception of update window messages from the program to the operating system in response to the first message so that the update window messages from the program are not received by the operating system and to discontinue interception of the messages in response to the second message so that the update window messages are received by the operating system, wherein in response to intercepting an update window message, the driver module is configured to update the window data in the off screen memory according to the update window message; and to instruct the graphics processor to display the window with the updated window data using the transparent display mode.

29. The graphics processing subsystem of claim 28 wherein the graphics processor is further configured to transfer window data for the window from the display memory to the off screen memory during initiation of the transparent display mode and to subsequently transfer the window data for the window from the off screen memory to the display memory using an alpha blending transfer mode.

30. The graphics processing subsystem of claim 29 wherein the graphics processor is further configured to transfer the window data for the window from the off screen memory to the display memory during termination of the transparent display mode.

31. The graphics processing subsystem of claim 28 wherein the driver module is further configured such that, in response to the first message, the driver module instructs the operating system to enable a layered display mode for the window and, in response to the second message, the driver module instructs the operating system to disable the layered display mode for the window in response to the second message.

32. The graphics processing subsystem of claim 28 wherein the driver module is further configured such that, under a first operating condition and in response to the first message, the driver module instructs the graphics processor to initiate the transparent display mode for the window and, under a second operating condition and in response to the first message, the driver module invokes an automated layered mode of the operating system to display the window as transparent.

33. The graphics processing subsystem of claim 32 wherein the first operating condition occurs when complete window data for the window is present in the display memory and the second operating condition occurs when complete window data for the window is not present in the display memory.

34. The graphics processing subsystem of claim 28 wherein the driver module is further configured to instruct the operating system to hide the window in response to the first message and to instruct the operating system to no longer hide the window in response to the second message.

35. The graphics processing subsystem of claim 28 wherein the driver module is further configured to instruct the graphics processor to disregard drawing commands for the window in response to the first message and to instruct the graphics processor to no longer disregard drawing commands for the window in response to the second message.

36. The graphics processing subsystem of claim 28 wherein the first message is generated in response to a user action.

37. The graphics processing subsystem of claim 36 wherein the user action corresponds to initiating a window drag of the window.

38. The graphics processing subsystem of claim 36 wherein the user action includes selecting a transparency setting from a menu associated with the window.

39. The graphics processing subsystem of claim 36 wherein the user action includes pressing a transparency enabling key.

* * * * *